US012491447B2

(12) United States Patent
Li

(10) Patent No.: US 12,491,447 B2
(45) Date of Patent: Dec. 9, 2025

(54) TOY CAR

(71) Applicant: Shenzhen Sichuang Liwei Technology Co., Ltd., Shenzhen (CN)

(72) Inventor: Jing Li, Shenzhen (CN)

(73) Assignee: Shenzhen Sichuang Liwei Technology Co., Ltd., Shenzhen (CN)

( * ) Notice: Subject to any disclaimer, the term of this patent is extended or adjusted under 35 U.S.C. 154(b) by 0 days.

(21) Appl. No.: 19/023,265

(22) Filed: Jan. 15, 2025

(65) Prior Publication Data

US 2025/0153060 A1 May 15, 2025

(51) Int. Cl.

| | |
|---|---|
| ***A63H 17/05*** | (2006.01) |
| ***A63H 17/26*** | (2006.01) |
| ***A63H 17/44*** | (2006.01) |
| ***A63H 31/00*** | (2006.01) |

(52) U.S. Cl.

CPC ..... *A63H 17/05* (2013.01); *A63H 17/262* (2013.01); *A63H 17/44* (2013.01); *A63H 31/00* (2013.01)

(58) Field of Classification Search

CPC ..... A63H 17/44; A63H 17/05; A63H 17/004; A63H 31/00; A63H 33/003

See application file for complete search history.

(56) References Cited

U.S. PATENT DOCUMENTS

| | | | | | |
|---|---|---|---|---|---|
| 3,132,864 | A * | 5/1964 | Glass | A63F 7/305 | 273/127 R |
| 3,197,918 | A * | 8/1965 | Coggeshall | A63H 7/04 | 446/290 |
| 3,641,704 | A * | 2/1972 | Sims | A63H 18/14 | 124/78 |
| 4,031,659 | A * | 6/1977 | Keller | A63H 17/05 | 446/427 |
| 4,140,325 | A * | 2/1979 | Tucker | A63G 19/00 | 198/515 |
| 4,171,133 | A * | 10/1979 | Morrison | A63H 33/00 | 446/289 |
| 4,248,006 | A * | 2/1981 | Jones | A63H 17/002 | 446/89 |
| 4,262,443 | A * | 4/1981 | Ferris | A63H 13/02 | 446/289 |
| 4,568,307 | A * | 2/1986 | Gabler | A63H 7/04 | 446/466 |

(Continued)

FOREIGN PATENT DOCUMENTS

| | | |
|---|---|---|
| CN | 201220110 Y | 4/2009 |
| CN | 217163192 U | 8/2022 |

(Continued)

OTHER PUBLICATIONS

Translation KR20170087792A (Year: 2017).*

*Primary Examiner* — Eugene L Kim
*Assistant Examiner* — Alyssa M Hylinski

(57) ABSTRACT

The invention relates to a toy car, which comprises a car head and a car body, the car head being connected with the car body; the car head comprises a base, a first channel is arranged in the base, the base is further provided with a swallowing mechanism, the swallowing mechanism comprises two swallowing wheels arranged on the base, and the two swallowing wheels are rotatably connected to two sides of the first channel respectively; and an object to be swallowed is swallowed into the first channel through the swallowing wheels.

8 Claims, 12 Drawing Sheets

(56) References Cited

U.S. PATENT DOCUMENTS

| | | | | | |
|---|---|---|---|---|---|
| 4,614,504 | A * | 9/1986 | Yamasaki | A63H 33/003 | 446/424 |
| 4,840,242 | A * | 6/1989 | Chih | B62D 57/02 | 180/65.6 |
| 5,015,210 | A * | 5/1991 | Dideriksen | A63H 17/44 | 446/236 |
| 5,052,680 | A * | 10/1991 | Malewicki | B23D 17/00 | 446/376 |
| 11,957,992 | B1 * | 4/2024 | Hwang | A63H 33/003 | |
| 2009/0253349 | A1 * | 10/2009 | Iwakoshi | A63H 17/26 | 446/429 |

FOREIGN PATENT DOCUMENTS

| | | | | | |
|---|---|---|---|---|---|
| CN | 217661483 | U | | 10/2022 | |
| KR | 20170087792 | A | * | 7/2017 | A63H 33/003 |

* cited by examiner

TOY CAR

TECHNICAL FIELD

The present invention relates to the technical field of toy cars, in particular to a toy car with a car head capable of implementing a swallowing action.

BACKGROUND OF THE PRESENT INVENTION

Toy cars have always been popular in children. At present, there are various forms of toy cars on the market, such as a toy car capable of being assembled into a track and a carrier vehicle for storing a small toy car. However, for the tack-type toy car, the track assembly is troublesome, and at the same time, there are many parts, which are easy to be lost, and the track occupies a space, which is not conducive to being placed in houses. Moreover, the toy car provided by the prior art has the disadvantages of simple structure, no transformability and low playability. Therefore, it is necessary to design a transformable toy car, which can be transformed into an animal form, and a head of the toy car is provided with a swallowing mechanism capable of swallowing articles (such as a small car model). In addition, a carrier carriage of the toy car may be transformed into a track form, so as to provide a variety of transformation forms, thus improving the fun of the toy car.

SUMMARY OF THE PRESENT INVENTION

The present invention provides a toy car, which solves the problems of simple structure, no transformability, low playability, and the like of a toy car in the prior art, and the solution of the present invention for solving the above technical problems is as follows.

A toy car is provided, the toy car comprises a car head and a car body, and the car head is connected with the car body; the car head comprises a base, a first channel is arranged in the base, the base is further provided with a swallowing mechanism, the swallowing mechanism comprises two swallowing wheels arranged on the base, and the two swallowing wheels are rotatably connected to two sides of the first channel respectively; and an object to be swallowed is swallowed into the first channel through the swallowing wheels.

Preferably, the swallowing wheel comprises a rolling cylinder, and a plurality of protrusions are arranged on a periphery of the rolling cylinder.

Preferably, an upper gear is arranged above the rolling cylinder, the swallowing mechanism further comprises a driving gear, a driven gear and a transmission gear, and the driving gear is meshed with the driven gear; the driven gear is meshed with the transmission gear, and the transmission gear is meshed with the upper gear; and axes of the driving gear, the driven gear and the transmission gear are parallel, and the axis of the transmission gear is perpendicular to the axis of the upper gear.

Preferably, the transmission gear comprises a first gear and a second gear which are fixedly connected, and diameters of the first gear and the second gear are different, wherein the first gear is meshed with the driven gear, and the second gear is vertically meshed with the upper gear.

Preferably, the driving gear is fixedly connected with a car wheel arranged at a lower portion of the car head.

Preferably, two sides of the base are both provided with a first hinge shaft and a second hinge shaft, and two third hinge shafts are arranged in front of the base, wherein the driven gear is sleeved on the first hinge shaft, the driving gear is sleeved on the second hinge shaft, and the swallowing wheel is sleeved on the third hinge shaft.

Preferably, two sides of the base are both fixedly connected with a side cover, an inner side of the side cover is provided with a supporting column, and the transmission gear is sleeved on the supporting column.

Preferably, the toy car is a transformable toy car, the car head further comprises an upper head, and the upper head is rotatably connected to the base.

Preferably, the base and the swallowing mechanism form a lower head, and the lower head and the upper head form an animal head shape with a mouth capable of being opened and closed.

Preferably, the car body comprises a car seat, the car seat is fixedly connected with the base, a lower portion of the car seat is connected with the car wheel, the lower portion of the car seat is further connected with four rotatable supporting legs, when the four supporting legs rotate upward to be folded, the car seat makes contact with the ground through the car wheels, and when the four supporting legs rotate downward to be unfolded, the car seat makes contact with the ground through the supporting legs.

The present invention has the beneficial effects that: the toy car provided by the present invention has the following advantages.

1. The car head comprises the lower head and the upper head, the upper head and the lower head are rotatably connected, the lower head and the upper head form the animal head shape with the mouth capable of being opened and closed, the lower portion of the car seat is also connected with the four rotatable supporting legs, and when the four supporting legs rotate downward to be unfolded, the toy car is transformed into the animal form.

2. The lower head comprises the base and the swallowing mechanism arranged on the base, the first channel is arranged in the base, the two swallowing wheels are rotatably connected to two sides of the first channel respectively, and the object to be swallowed (such as a small car model) is swallowed into the first channel through the swallowing wheels.

3. The car seat, a middle car carriage and a car roof are arranged in a pull-out sliding connection mode, and in a transportation form, the car seat, the middle car carriage and the car roof are stacked in sequence from bottom to top; in a track form, the car seat, the middle car carriage and the car roof are connected end to end to form a linear track; by pulling the middle car carriage and the car roof, the toy carrier vehicle can be switched between the transportation form and the track form, and then the toy track may be assembled by a simple operation, without causing a loss of parts of the toy track; and in addition, after the carrier vehicle is transformed into the transportation form, the car seat, the middle car carriage and the car roof are stacked up and down to save space, thus facilitating storage.

4. The car head is set to be in a dinosaur head form, eyes of the dinosaur head are provided with luminous parts, and a top portion of the dinosaur head is provided with a sound part; and the first channel is a mouth of the dinosaur head, a bottom portion of the car seat is provided with a second channel, the first channel is communicated with the second channel, by pushing the toy car, the small car model is swallowed by the swallowing mechanism to enter from the first channel, and then slides out from the second channel to simulate the state that the dinosaur head swallows the small car, which provides a variety of playing modes for the toy carrier vehicle, thus improving the fun.

The above description is only an overview of the technical solutions of the present invention, in order to better understand the technical means of the present invention and implement the technical means according to the contents of the specification, the detailed description is made hereinafter with the preferred the embodiments of the present invention and the accompanying drawings. Specific embodiments of the present invention are given in detail with reference to the following embodiments and the drawings.

DESCRIPTION OF THE DRAWINGS

The drawings described herein are used for providing further understanding for the present invention, and constitute a part of the present invention. Exemplary embodiments of the present invention and the descriptions thereof are used for explaining the present invention, and do not constitute any inappropriate limitation to the present invention. In the drawings.

Figure 1:
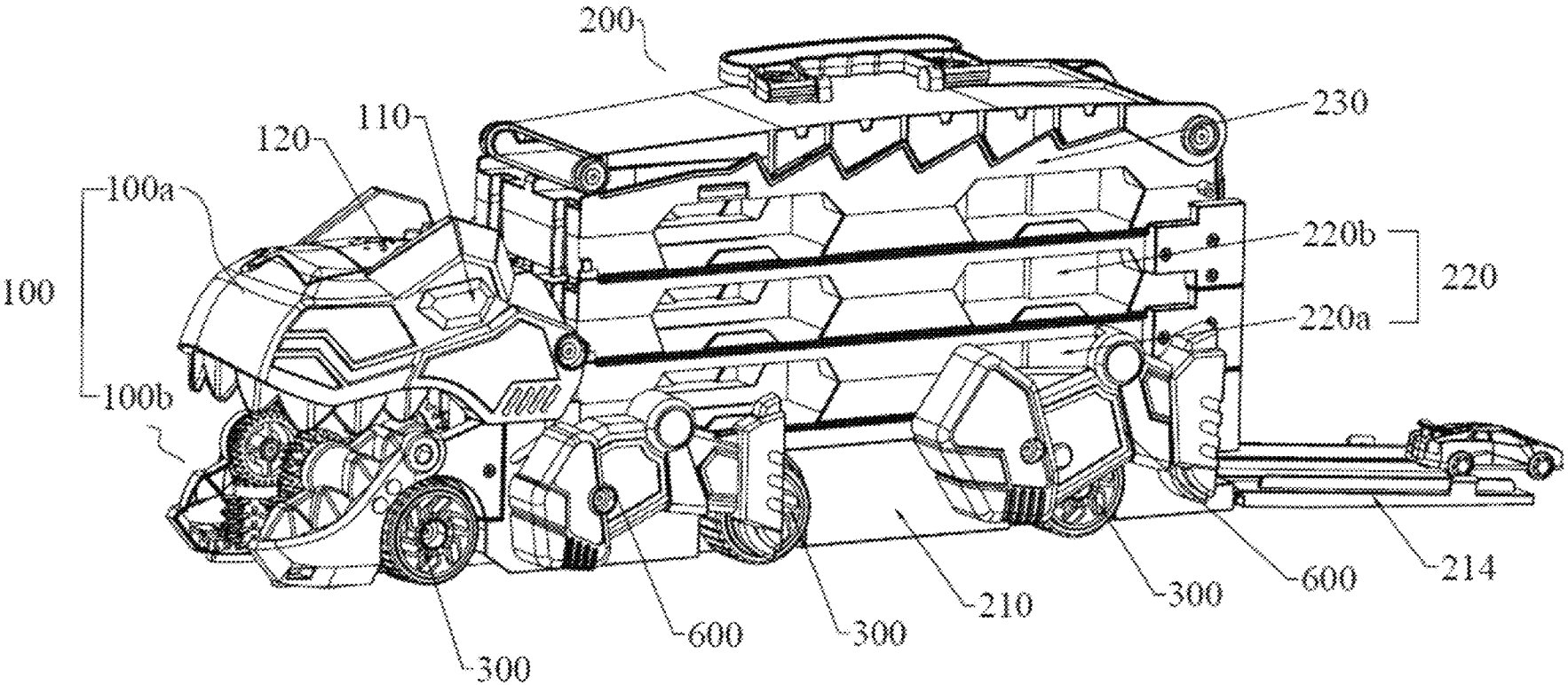
FIG. 1 is a schematic diagram of an overall structure of a toy car according to the present invention.

In the drawings, the components represented by various reference numerals are listed as follows:

100 refers to car head; 100*a* refers to upper head; 110 refers to luminous part; 120 refers to sound part; 130 refers to emitter; 131 refers to pressing head; 132 refers to firing plate; 133 refers to spring; 100*b* refers to lower head; 140 refers to base; 141 refers to first channel; 142 refers to first hinge shaft; 143 refers to the second hinge shaft; 144 refers to third hinge shaft; 145 refers to fourth hinge shaft; 150 refers to driving gear; 160 refers to driven gear; 170 refers to transmission gear; 171 refers to first gear; 172 refers to second gear; 180 refers to swallowing wheel; 181 refers to swallowing gear; 182 refers to rolling cylinder; 1821 refers to protrusion; 190 refers to side cover; and 191 refers to supporting column;

200 refers to car body; 210 refers to car seat; 213 refers to second channel; 214 refers to tailboard; 215 refers to fifth hinge shaft; 216 refers to sixth hinge shaft; 220 refers to middle car carriage; 220*a* refers to first car carriage; 220*b* refers to second car carriage; and 30 refers to car roof;

300 refers to car wheel;

400 refers to track; 410 refers to left track; and 420 refers to right track; and

600 refers to supporting leg.

DETAILED DESCRIPTION OF PREFERRED EMBODIMENTS

The principle and feature of the present invention are described hereinafter with reference to FIG. 1 to FIG. 13, and the examples are only used to explain the present invention, and are not intended to limit the scope of the present invention. In the following paragraphs, the invention present is described in more detail by illustration with reference to the drawings. The advantages and features of the present invention will become more apparent according to the following description and the claims. It should be noted that all the drawings are in a very simplified form and use an inaccurate proportion, which are only used to facilitate and clearly illustrate the purposes of the embodiments of the present invention.

It should be noted that when the component is expressed to be "fixed" to another component, it may be directly on another component, or there may be an intermediate component in between. When one component is considered to be "connected" to another component, it may be directly connected to another component, or there may be an intermediate component in between at the same time. When one component is considered to be "arranged" to another component, it may be directly arranged to another component, or there may be an intermediate component in between at the same time. The terms "vertical", "horizontal", "left", "right", and similar expressions used herein are for illustrative purposes only.

Unless otherwise defined, all technical and scientific terms used herein have the same meanings as those commonly understood by those skilled in the technical field of the present invention. The terms used in the specification of the present invention herein are only for the purpose of describing specific embodiments, and are not intended to limit the present invention. The term "and/or" used herein comprises any and all combinations of one or more associated items listed.

Embodiment

The present invention provides a toy car, and as shown in FIG. 1, the toy car comprises a car head 100 and a car body 200, and the car head 100 is connected with the car body 200; bottom portions of the car head 100 and the car body 200 are respectively provided with a car wheel 300 to allow the toy car to be rolled and pushed; and the car body 200 comprises a car seat 210, a lower portion of the car seat 210 is connected with the car wheel 300, the car head 100 comprises a lower head 100*a* and an upper head 100*a*, the lower head 100*b* comprises a base 140 and a swallowing mechanism arranged on the base 140, the base 140 is arranged below the car head 100, the upper head 100*a* and the lower head 100*a* are rotatably connected (by rotatably connecting the upper head 100*a* to the base 140), and a first channel 141 is arranged in the base 140.

Figure 2:
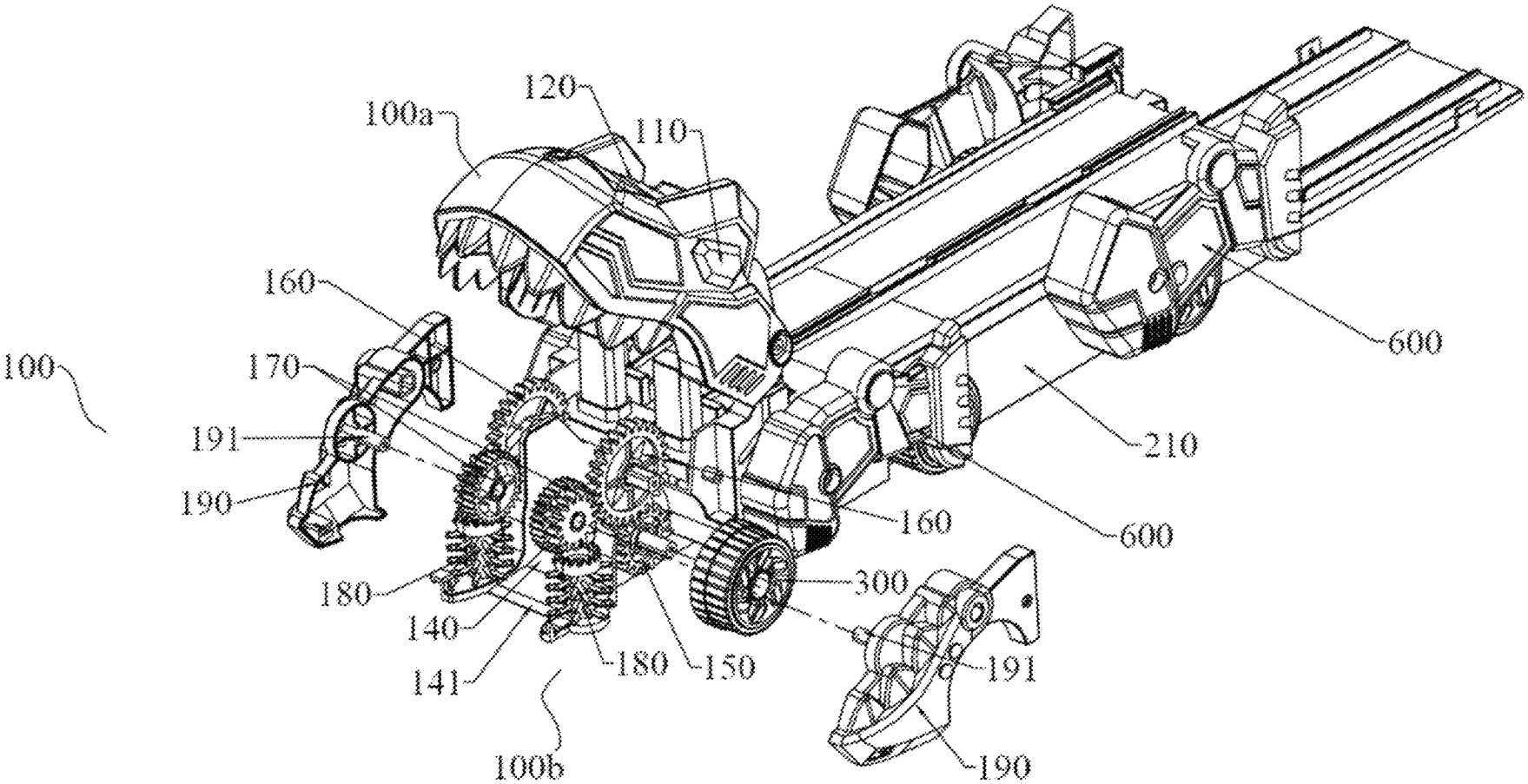
FIG. 2 is a schematic diagram of an exploded structure of a swallowing mechanism of the toy car according to the present invention.
Figure 3:
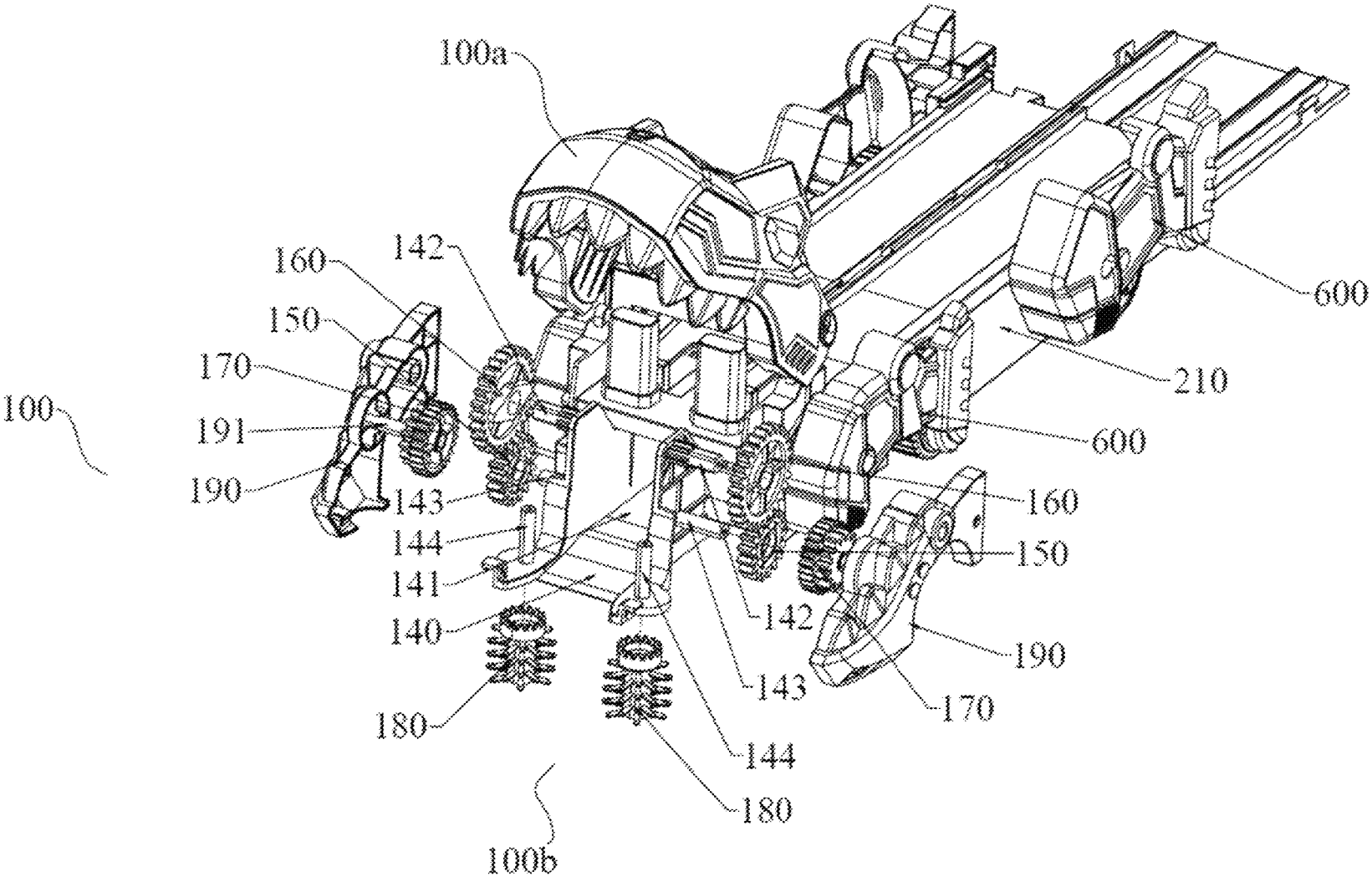
FIG. 3 is a schematic diagram of another exploded structure of the swallowing mechanism of the toy car according to the present invention.

As shown in FIG. 2 to FIG. 3, the swallowing mechanism comprises a driving gear 150, a driven gear 160, a transmission gear 170 and a swallowing wheel 180; the driving gear 150 is meshed with the driven gear 160, the driven gear 160 is meshed with the transmission gear 170, and the transmission gear 170 is meshed with the upper gear 181; and axes of the driving gear 150, the driven gear 160 and the transmission gear 170 are parallel, and the axis of the transmission gear 170 is perpendicular to the axis of the upper gear 181.

The swallowing mechanisms are arranged on two sides of the first channel 141, two swallowing wheels 180 are rotatably connected to two sides of the first channel 141 respectively, and an object to be swallowed (such as a small car model) is swallowed into the first channel 141 through the swallowing wheels 180.

Figure 4:
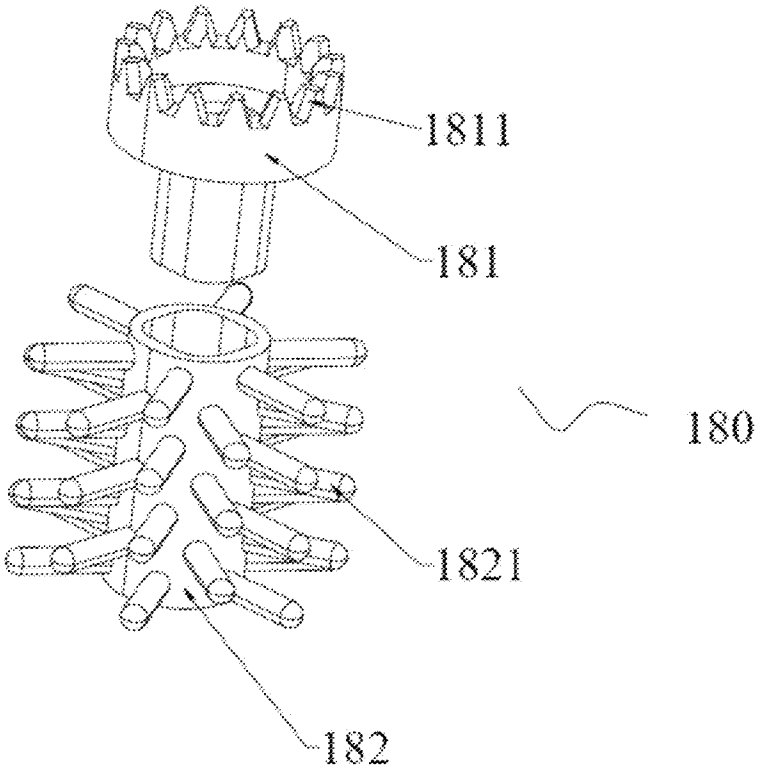
FIG. 4 is a schematic structural diagram of a swallowing wheel of the toy car according to the present invention.

As shown in FIG. 4, the swallowing wheel 180 comprises an upper gear 181 and a rolling cylinder 182, the upper gear 181 is arranged above the rolling cylinder 182, and teeth of the upper gear 181 are uniformly arranged along a periphery of the cylinder; and the upper gear 181 and the rolling cylinder 182 are matched in an inserted manner, and the upper gear 181 may be inserted into the rolling cylinder 182 from top to bottom, so that the upper gear 181 and the rolling cylinder 182 cannot rotate relatively. Further, a plurality of protrusions 1821 are arranged on a periphery of the rolling cylinder 182, the plurality of protrusions 1821 are in a strip shape, and especially made of flexible materials, such as soft plastic or silica gel, and the object to be swallowed is swallowed and conveyed into the first channel 141 through a contact friction between the strip-shaped protrusions 1821 and the object to be swallowed (such as the small car model).

Figure 5:
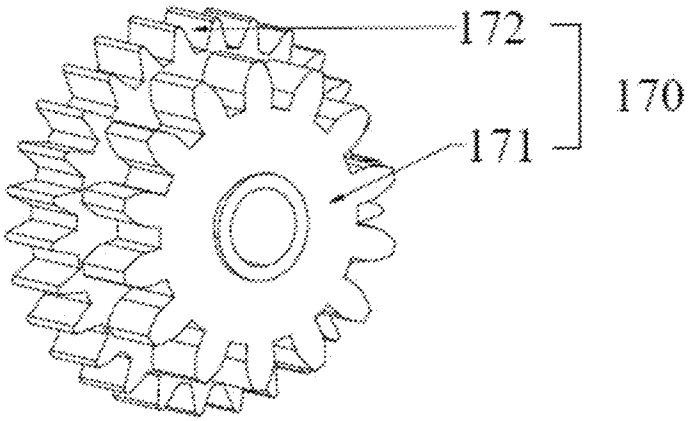
FIG. 5 is a schematic structural diagram of a transmission gear of the toy car according to the present invention.

In order to realize the transmission connection of the gears of the swallowing mechanism, as shown in FIG. 5, the transmission gear 170 comprises a first gear 171 and a second gear 172 which are fixedly connected, and the first gear 171 and the second gear 172 may be fixedly connected by a bolt, welding or bonding, or manufactured by integral molding. In order to facilitate setting a rotation speed of the swallowing wheel 180, the first gear 171 and the second gear 172 are set to have different diameters, for example, the diameter of the first gear 171 is set to be smaller than that of the second gear 172, wherein the first gear 171 is meshed with the driven gear 160, and the second gear 172 is vertically meshed with the upper gear 181.

In order to drive the swallowing wheel 180 to rotate, a motor may be arranged to be in transmission connection with the driving gear 150, and the driving gear 150 is driven to rotate by the motor, so as to drive the swallowing wheel 180 to automatically swallow the object to be swallowed (such as the small car model).

In addition, the object to be swallowed (such as the small car model) may also be swallowed without relying on an electric driving mechanism, for example, the driving gear 150 is fixedly connected with the car wheel 300 arranged at the lower portion of the car head 100; and when the toy car is pushed to move, the car wheel 300 rolls, and with the rotation of the car wheel 300, the swallowing wheel 180 also rotates, so as to swallow the object to be swallowed (such as the small car model) into the first channel 141, thus implementing a swallowing action.

Figure 6:
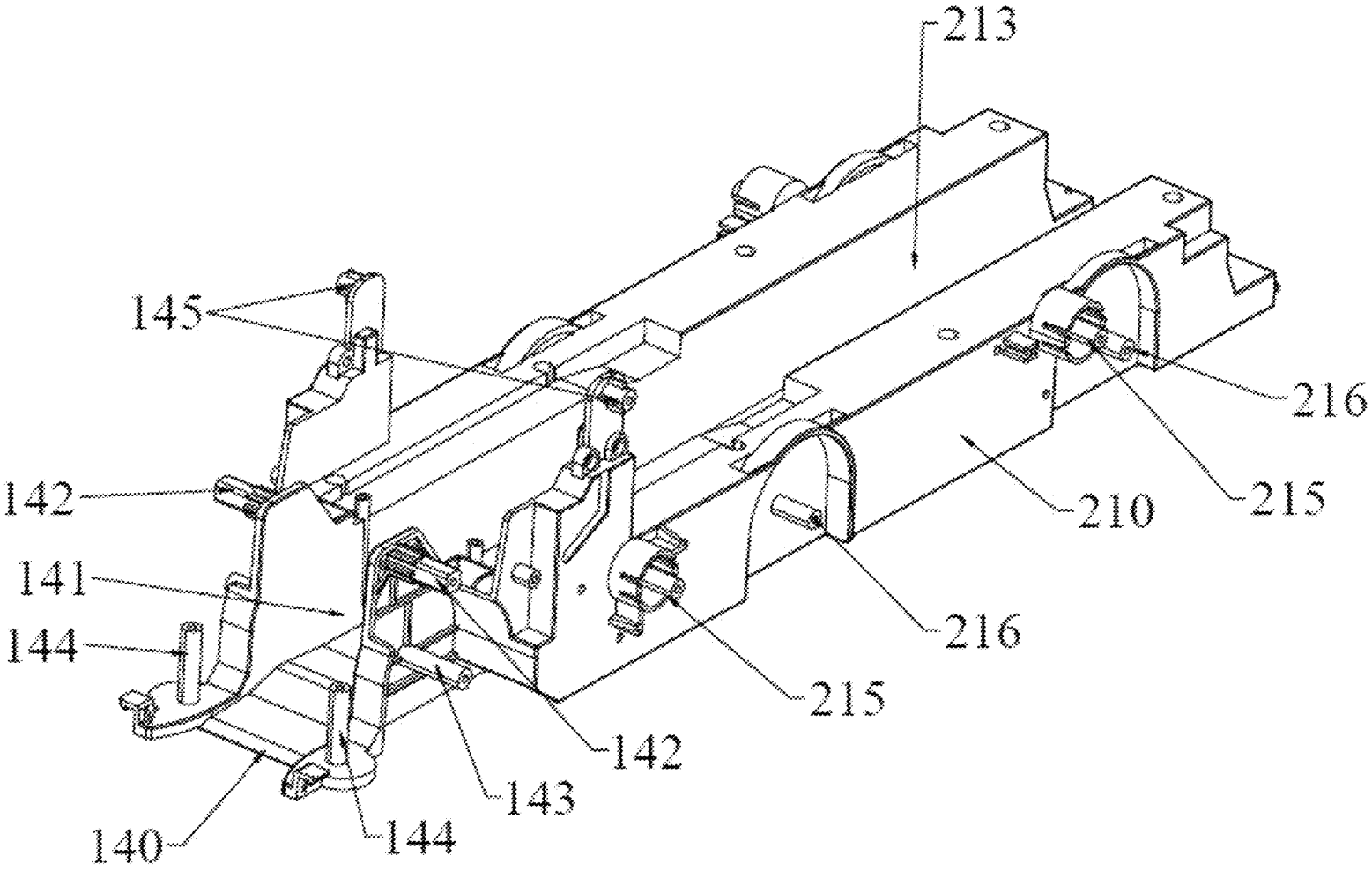
FIG. 6 is a schematic structural diagram of a base and a car seat of the toy car according to the present invention.

In order to connect the gears of the swallowing mechanism, as shown in FIG. 6, two sides of the base 140 are both provided with a first hinge shaft 142 and a second hinge shaft 143, and two third hinge shafts 144 are arranged in front of the base 140, wherein the driven gear 160 is sleeved on the first hinge shaft 142, the driving gear 150 is sleeved on the second hinge shaft 143, and the swallowing wheel 180 is sleeved on the third hinge shaft 144. Further, two sides of the base 140 are both fixedly connected with a side cover 190, an inner side of the side cover 190 is provided with a supporting column 191, and the transmission gear 170 is sleeved on the supporting column 191. When the side cover 190 is fixedly connected with the base 140, the transmission gear 170 is stably arranged on the supporting column 191 and stably meshed with the driven gear 160 and the upper gear 181; an upper portion of the base 140 is further provided with a fourth hinge shaft 145, and the upper head 100*a* is rotatably connected to the base 140 through the fourth hinge shaft 145; and a rear side of the base 140 is connected with a car seat 210, and the car seat 210 and the base 140 are fixedly connected (such as being fixedly connected by a bolt, welding, bonding or integral molding). In the embodiment of the present invention, the car seat 210 and the base 140 are integrally molded, a bottom portion of the car seat 210 is provided with a second channel 213, the first channel 141 is communicated with the second channel 213, and the small car model enters from the first channel 141 under an action of the swallowing mechanism, and then slides out from the second channel 213; and two sides of the car seat 210 are both provided with a fifth hinge shaft 215 and a sixth hinge shaft 216, the supporting leg is sleeved on the fifth hinge shaft 215 and rotatably connected with the car seat 210, and the car wheel 300 is sleeved on the sixth hinge shaft 216 and rotatably connected with the car seat 210.

Further, in order to increase the fun of the toy car, the toy car is set to be a transformable toy car, and as shown in FIG. 1 to FIG. 3, the lower head 100*b* and the upper head 100*a* form an animal head shape with a mouth capable of being opened and closed, and the animal head shape may imitate various animal characters in nature, such as a dinosaur, a rhinoceros, a lion and a tiger.

Figure 7:
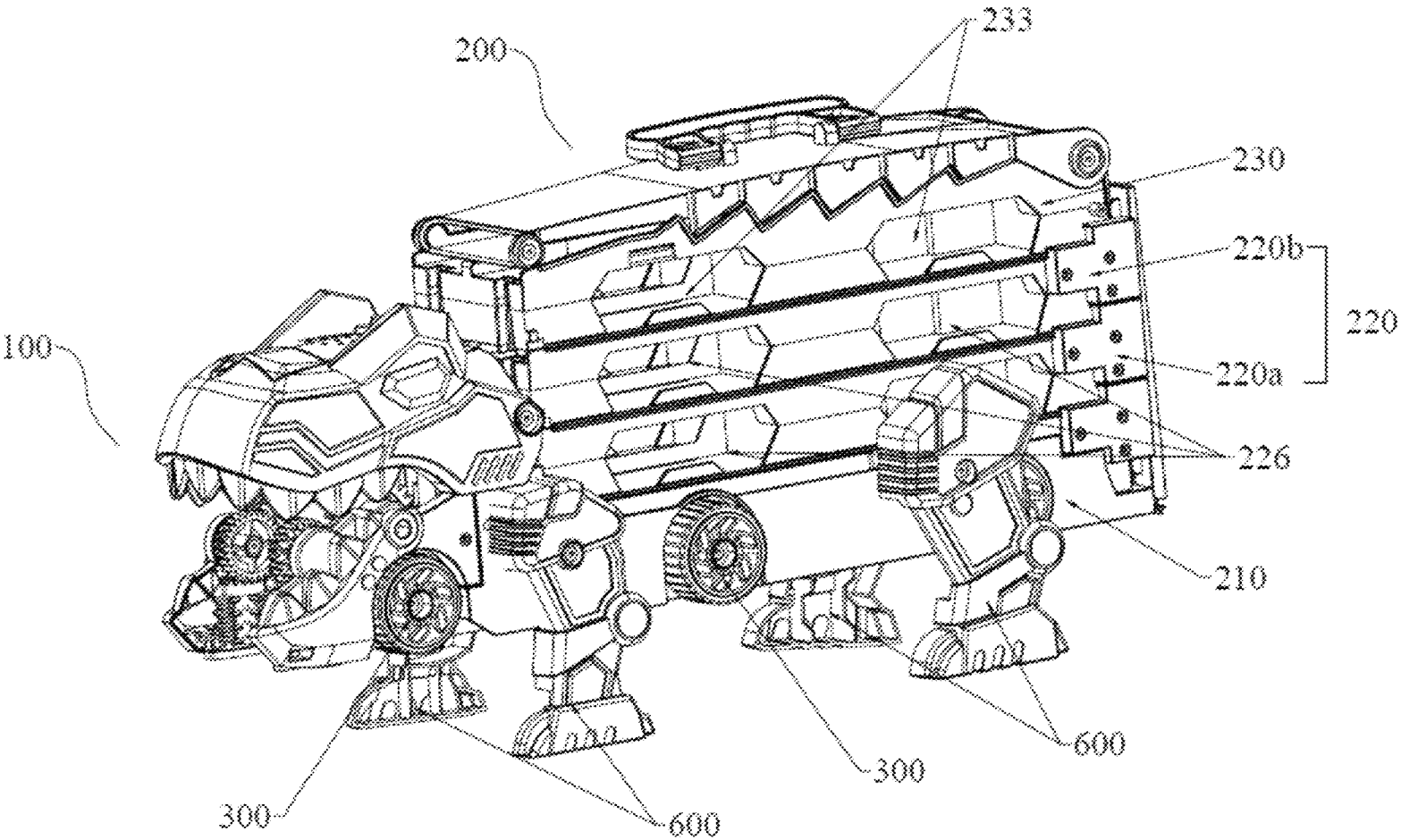
FIG. 7 is a schematic structural diagram of the toy car according to the present invention when transformed into a dinosaur form.
Figure 8:
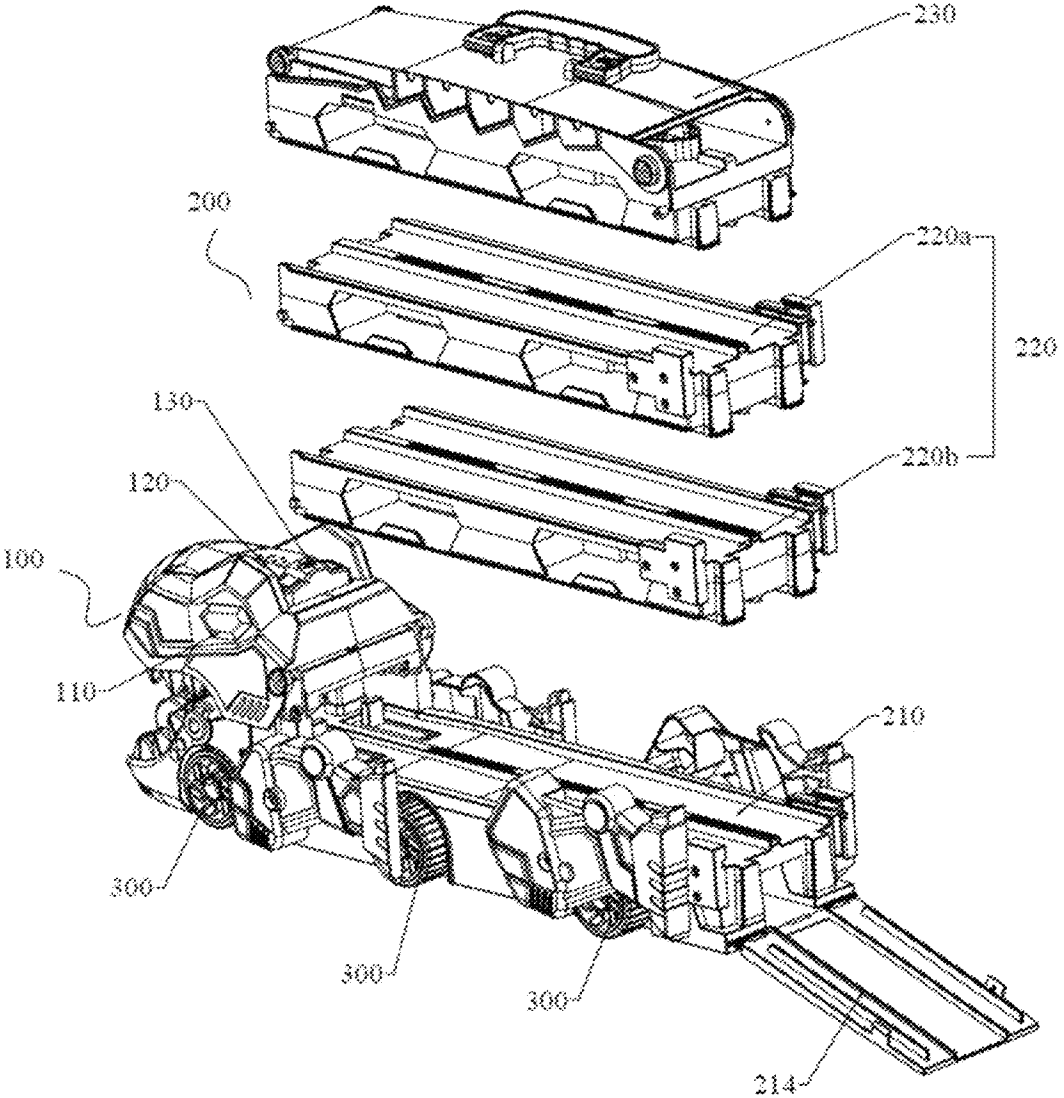
FIG. 8 is a schematic diagram of an exploded structure of a car body of the toy car according to the present invention.
Figure 9:
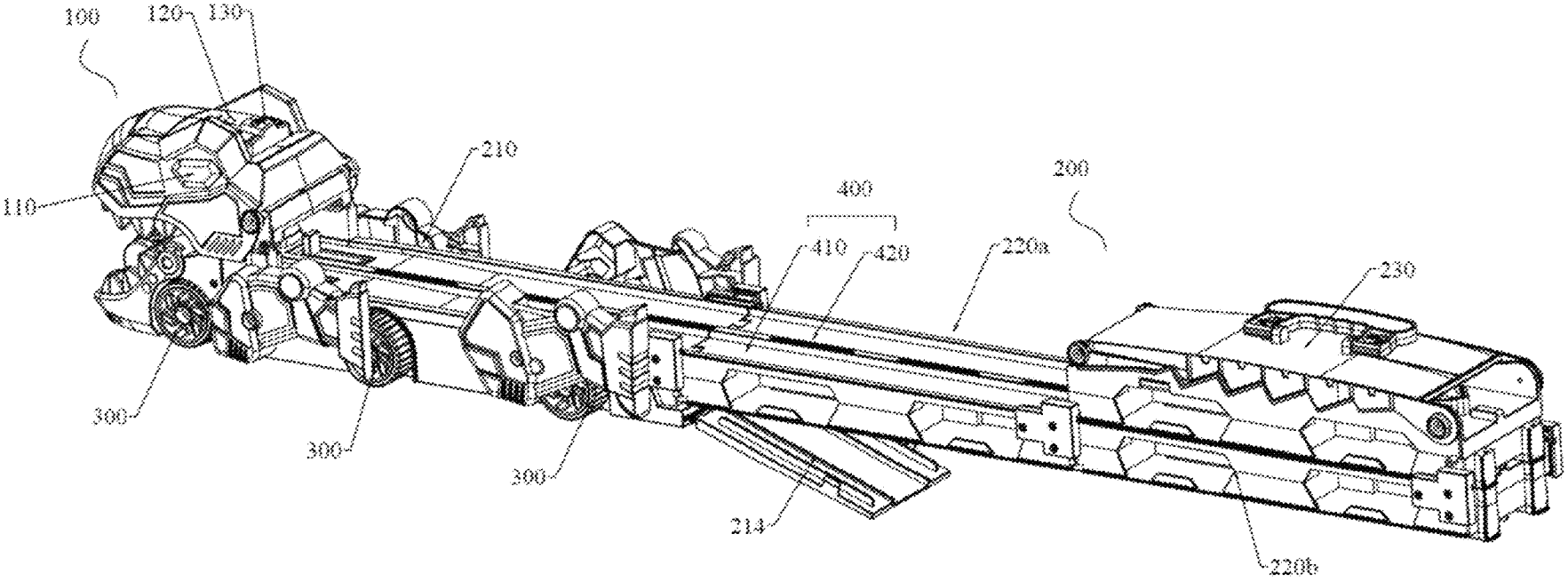
FIG. 9 is a schematic structural diagram of the car body of the toy car according to the present invention in pull-out sliding.
Figure 10:
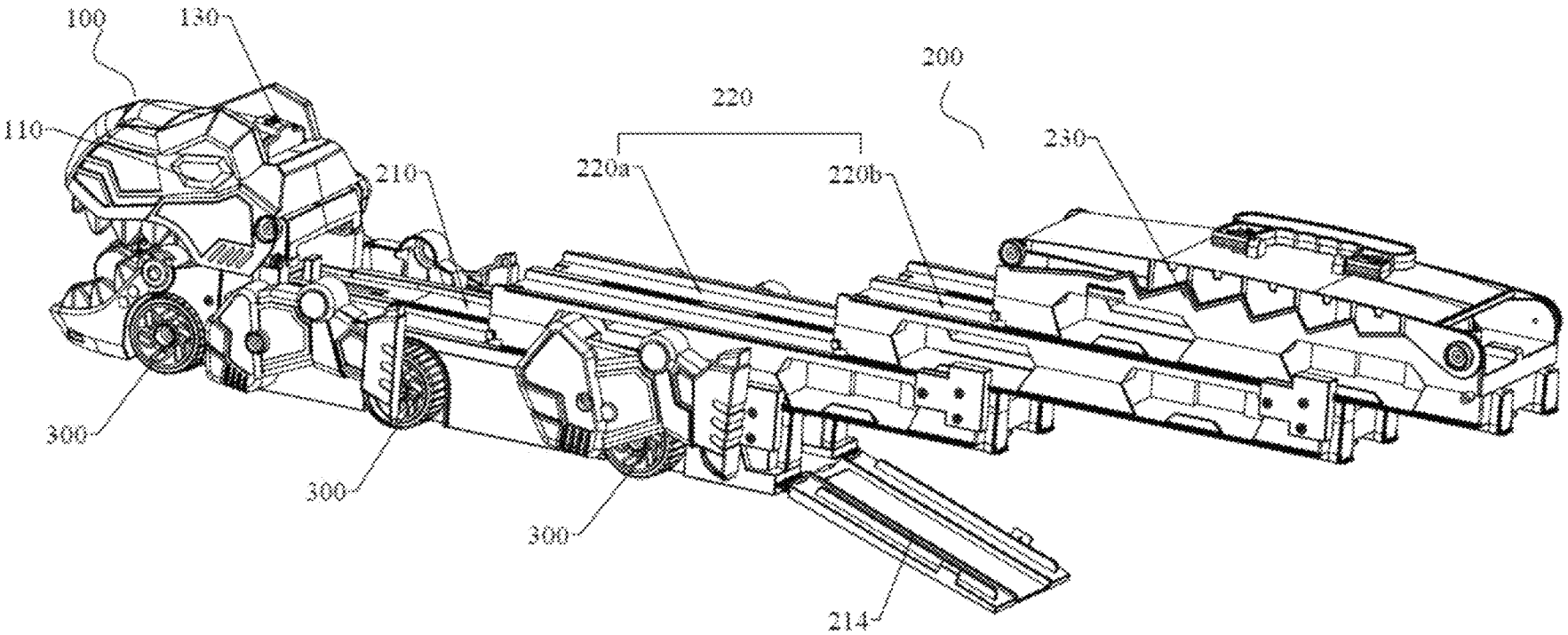
FIG. 10 is another schematic structural diagram of the car body of the toy car according to the present invention in pull-out sliding.
Figure 11:
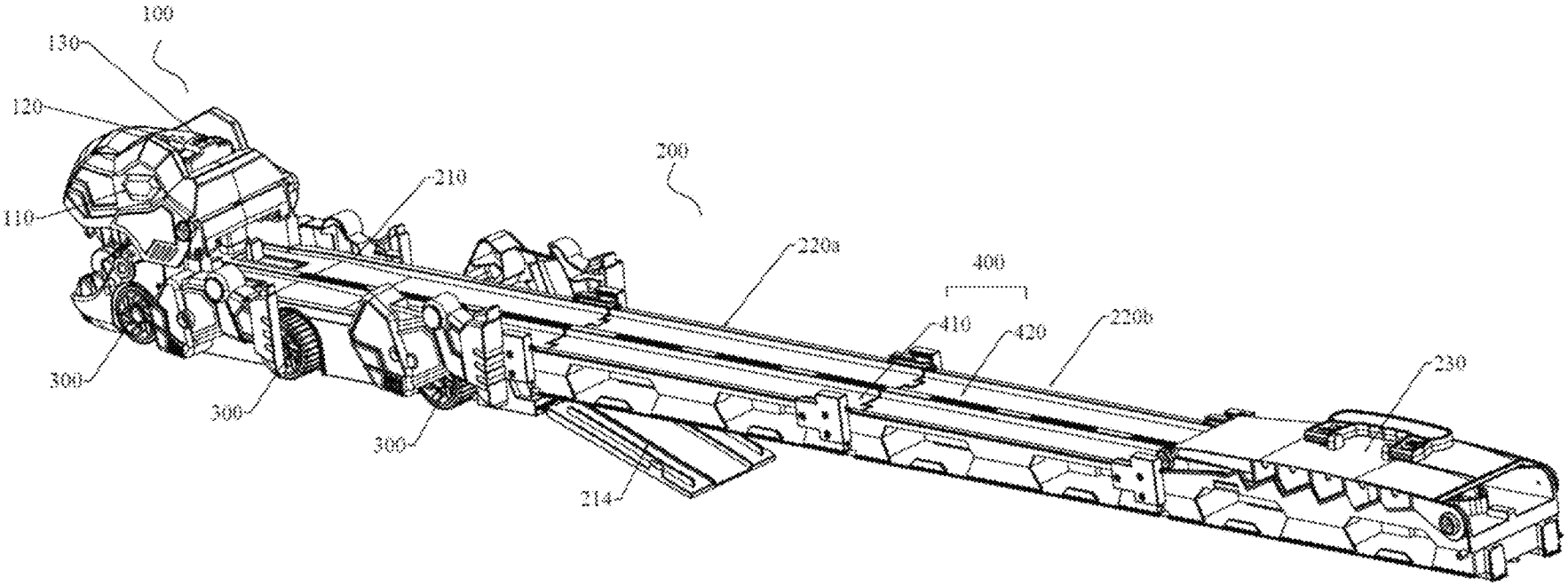
FIG. 11 is another schematic structural diagram of the car body of the toy car according to the present invention in pull-out sliding.

As shown in FIG. 1 and FIG. 6 to FIG. 7, the car body 200 comprises a car seat 210, a lower portion of the car seat 210 is connected with the car wheel 300, the lower portion of the car seat 210 is also connected with four rotatable supporting legs 600, when the four supporting legs 600 rotate upward to be folded, the toy car is transformed into a car form, and at this time, the car seat 210 makes contact with the ground through the car wheels 300; and when the four supporting legs 600 rotate downward to be unfolded, the car seat 210 makes contact with the ground through the supporting legs 600, the car wheels 300 are suspended above the ground, and the toy car is transformed into an animal form, such as a dinosaur form as shown in FIG. 7. In addition, toy cars in different animal forms may be obtained by replacing the car head of the toy car by other animal head shapes, such as a rhinoceros, a lion and a tiger.

Further, as shown in FIG. 7 to FIG. 12, the car body 200 further comprises a middle car carriage 220 arranged above the car seat 210 and a car roof 230, the middle car carriage 220 and the car roof 230 of the car body 200 may be used for storing a plurality of small car models, a plurality of first cavities 226 are arranged in the middle car carriage 220, a plurality of second cavities 233 are arranged in a top car carriage 231, and the first cavity 226 and the second cavity 233 are used for storing the plurality of small car models.

Figure 12:
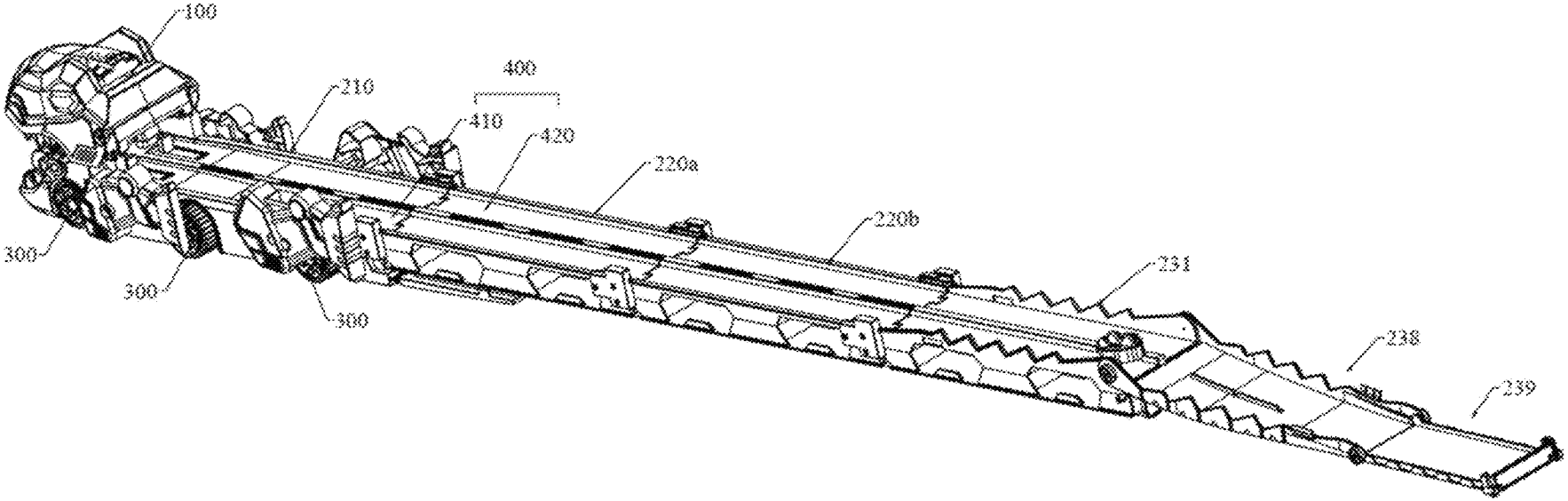
FIG. 12 is a schematic structural diagram of the toy car according to the present invention in a track form.

Further, the car seat 210, the middle car carriage 220 and the car roof 230 of the car body 200 are in pull-out sliding connection, and by pulling the middle car carriage 220 and the car roof 230, the toy car can be switched between a transportation form and a track form. In order to flexibly control a storage capacity of a trailer or increase a length of a track 400, the middle car carriage 220 is set to comprise at least one car carriage, and car carriages are slidably connected, for example, the middle car carriage 220 comprises a first car carriage 220*a* and a second car carriage 220*b*, the first car carriage 220*a* and the second car carriage 220*b* have exactly the same structure and are slidably connected. In the transportation form (as shown in FIG. 1 and FIG. 7), the car seat 210, the middle car carriage 220 and the car roof 230 are stacked in sequence from bottom to top, the middle car carriage 220 and the car roof 230 achieve the purpose of storing the small car model, a tail portion of the car seat 210 is hinged with a tail plate 214, and the tail plate 214 used for preventing the small car model from sliding out of the first cavity 226 or the second cavity 233; and in the track form (as shown in FIG. 12), the middle car carriage 220 and the car roof 230 are pulled, so that the car seat 210, the middle car carriage 220 and the car roof 230 are connected end to end, and a linear track 400 is formed (by pulling the middle car carriage 220 and the car roof 230).

In order to improve the fun of the toy car, further, the upper head 100*a* of the car head 100 is provided with a luminous part 110, a sound part 120 and an emitter 130; and the emitter 130 is used for providing power for the small car model, so as to drive the small car model on the track 400.

Figure 13:
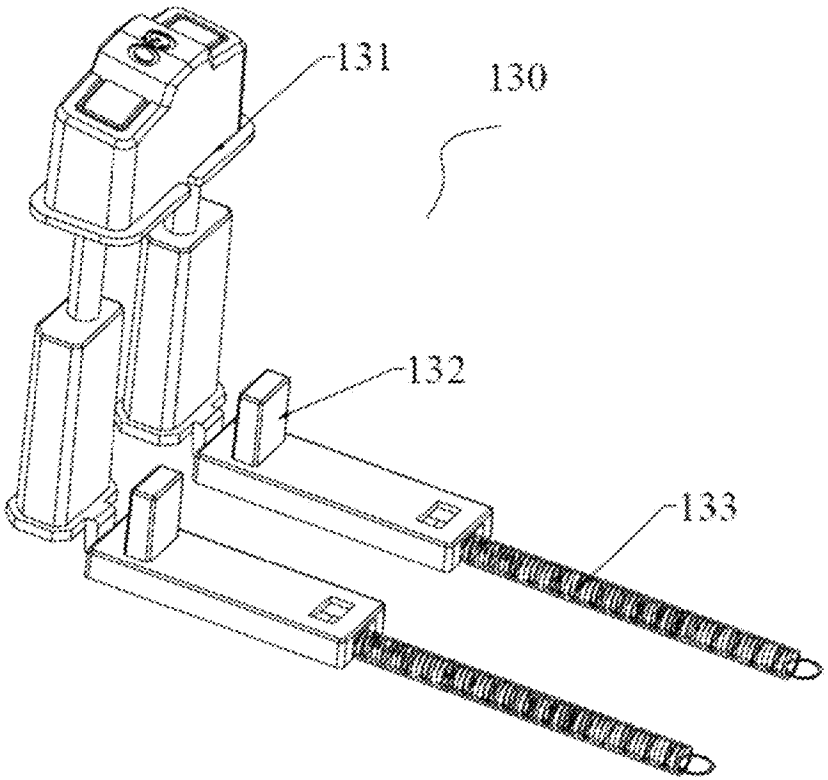
FIG. 13 is a schematic structural diagram of an emitter of the toy carrier vehicle according to the present invention.

As shown in FIG. 13, the emitter 130 comprises a pressing head 131, a firing plate 132 and a spring 133, the pressing head 131 is arranged at a top portion of the dinosaur head, the firing plate 132 is arranged at a front portion of the car seat 210, one end of the spring 133 is fixedly connected with the car seat 210 and the other end of the spring is connected with the firing plate 132, and a bottom portion of the pressing head 131 is clamped with the firing plate 132. When the toy car is in the track form, the car seat 210, the middle car carriage 220 and the car roof 230 are unfolded to form the track 400, and the track 400 comprises a left track 410 and a right track 420. Two small toy cars are respectively placed in positions of two firing plates 132, and a downward force is exerted on the pressing head 131 to release a clamping effect of the pressing head 131 on the firing plate 132. At this time, under an action of the spring 133, the firing plate 132 quickly moves to the back of the track 400 to provide an initial thrust for the small toy car, so as to drive the small toy car on the left track 410 and the right track 420. The two small car models may race to improve the fun.

As shown in FIG. 1 and FIG. 7, when the toy car is in the dinosaur form, the car head 100 is a dinosaur head, eyes of the dinosaur head are provided with the luminous parts 110, and a top portion of the dinosaur head is provided with the sound part 120. When the downward force is exerted to the pressing head 131, the eyes of the dinosaur head emit light and generate sound (such as a dinosaur sound, a music sound or a knocking sound) at the same time, which improves the interaction between the toy car and children. The first channel 141 is a mouth of the dinosaur head, the bottom portion of the car seat 210 is provided with the second channel 213, the first channel 141 is communicated with the second channel 213, and by pushing the toy car, the small car model enters from the first channel 141 under an action of the swallowing mechanism, and then slides out from the second channel 213 to simulate the state that the dinosaur head swallows the small car.

It should be noted that relational terms herein, such as first, second, and the like, are used merely to distinguish one entity or operation from another entity or operation, and do not necessarily require or imply that there is any such relationship or order between these entities or operations. What is not described in detail in the specification of the present invention belongs to the prior art commonly known to those skilled in the art.

The above are only the preferred embodiment of the present invention, and do not limit the present invention in any form. All ordinary skills in the industry may smoothly implement the present invention according to the drawings and the above. However, those skilled in the art may make some alterations, modifications and evolutions of equivalent changes by using the above-mentioned technical contents without departing from the scope of the technical solutions of the present invention, which are all equivalent embodiments of the present invention. Meanwhile, any alterations, modifications and evolutions of equivalent changes made to the above embodiments according to the essential technology of the present invention still belong to the scope of protection of the technical solutions of the present invention.

I claim:

1. A toy car, comprising a car head and a car body, the car head being connected with the car body; wherein, the car head comprises a base, a first channel is arranged in the base, the base is further provided with two swallowing mechanisms, each of the two swallowing mechanisms comprises a swallowing wheel arranged on the base, and the swallowing wheel of each of the two swallowing mechanisms is rotatably connected to a corresponding one of two sides of the first channel; and an object to be swallowed is swallowed into the first channel through the swallowing wheels;

wherein the swallowing wheel of each of the swallowing mechanisms comprises a rolling cylinder with an upper gear arranged above the rolling cylinder, and a plurality of protrusions are arranged on a periphery of each of the rolling cylinders; each of the swallowing mechanisms further comprises a driving gear, a driven gear and a transmission gear; and for each of the swallowing mechanisms: the driving gear is meshed with the driven gear, the driven gear is meshed with the transmission gear, and the transmission gear is meshed with the upper gear; axes of the driving gear, the driven gear and the transmission gear are parallel, and the axis of the transmission gear is perpendicular to an axis of the upper gear.

2. The toy car according to claim 1, wherein each of the transmission gears comprises a first gear and a second gear which are fixedly connected, and diameters of the first gear and the second gear of each of the transmission gears are different, wherein for each of the swallowing mechanisms: the first gear is meshed with the driven gear and the second gear is vertically meshed with the upper gear.

3. The toy car according to claim 1, wherein the driving gear of each of the swallowing mechanisms is fixedly connected with a respective car wheel arranged at a lower portion of the car head.

4. The toy car according to claim 1, wherein each of two sides of the base is provided with a first hinge shaft and a second hinge shaft, and two third hinge shafts are arranged in front of the base, wherein the driven gear of each of the swallowing mechanisms is sleeved on a corresponding one of the first hinge shafts, the driving gear of each of the swallowing mechanisms is sleeved on a corresponding one of the second hinge shafts, and the swallowing wheel of each of the swallowing mechanisms is sleeved on a corresponding one of the third hinge shafts.

5. The toy car according to claim 4, wherein each of the two sides of the base is fixedly connected with a side cover, an inner side of each side cover is provided with a supporting column, and the transmission gear of each of the swallowing mechanisms is sleeved on a corresponding one of the supporting columns.

6. The toy car according to claim 1, wherein the toy car is a transformable toy car, the car head further comprises an upper head, and the upper head is rotatably connected to the base.

7. The toy car according to claim 6, wherein the base and the two the swallowing mechanisms form a lower head, and the lower head and the upper head form an animal head shape with a mouth capable of being opened and closed.

8. The toy car according to claim 6, wherein the car body comprises a car seat, the car seat is fixedly connected with the base, a lower portion of the car seat is connected with a plurality of car wheels, the lower portion of the car seat is further connected with four rotatable supporting legs, when the four supporting legs rotate upward to be folded, the car seat makes contact with a ground through the second car wheels, and when the four supporting legs rotate downward to be unfolded, the car seat makes contact with the ground through the supporting legs.

* * * * *